United States Patent [19]

Tengelitsch

[11] Patent Number: 4,929,202

[45] Date of Patent: May 29, 1990

[54] POWER TRIM CYLINDER PROTECTIVE LOCKING DEVICE FOR AN INBOARD/OUTBOARD BOAT MOTOR

[76] Inventor: John J. Tengelitsch, 13103 Red Bud Trail, Buchanan, Mich. 49107

[21] Appl. No.: 322,646

[22] Filed: Mar. 13, 1989

[51] Int. Cl.[5] ..... F15B 15/26

[52] U.S. Cl. ..... 440/55; 92/23; 440/113

[58] Field of Search ..... 440/61, 900, 113, 53, 440/55; 114/172, 170; 248/640, 642; 92/15, 23; 298/17 B; 280/414.1, 414.3

[56] References Cited

U.S. PATENT DOCUMENTS

| | | | |
|---|---|---|---|
| 2,397,516 | 4/1946 | Stewart | 92/23 |
| 3,709,454 | 1/1973 | Hyde | 248/351 |
| 3,941,344 | 3/1976 | Paterson | 248/351 |
| 4,086,869 | 5/1978 | Woodruff | 440/61 |
| 4,122,758 | 10/1978 | Bieringer et al. | 92/23 |
| 4,331,431 | 5/1982 | Estes | 440/53 |
| 4,438,899 | 3/1984 | Perkins et al. | 248/642 |
| 4,501,561 | 2/1985 | Speelman | 440/61 |
| 4,557,460 | 12/1985 | Nakase | 248/642 |
| 4,651,964 | 3/1987 | Kendrick | 248/351 |
| 4,676,003 | 6/1987 | DuBois, Sr. | 33/168 R |
| 4,685,888 | 8/1987 | Brewer | 440/53 |

OTHER PUBLICATIONS

Quicksilver Accessories Catalog; Copyright Brunswick Corporation 1988; p. 60 Trailering Clips.

*Primary Examiner*—Sherman D. Basinger
*Assistant Examiner*—Ed Swinehart
*Attorney, Agent, or Firm*—Basile and Hanlon

[57] ABSTRACT

A support device maintains an outboard unit of a boat engine in a tilted position for travel. The outboard unit has a stationary drive shaft housing attached to the boat transom and a movable propeller drive unit pivotally attached with respect to the stationary drive shaft housing. A trim mechanism includes a cylinder, a hydraulically operated piston and an actuator rod engaged between the movable propeller drive unit and the stationary drive shaft housing for tilting the movable propeller drive unit to a desired angle between a lowered position and a raised position. The support device has an elongated rigid casing with a radial slot extending along the entire longitudinal length of the casing and a semi-rigid lining disposed within the casing forming a longitudinal aperture comunicating with the radial slot through the casing. With the trim mechanism in the raised position and the actuator rod extended, the casing is engageable over the actuator rod for supporting the movable propeller drive unit in the raised position for travel, wherein the rigid casing engages against the cylinder at one end and against a pivot support connection of the actuator rod to the propeller drive unit at another end. The semi-rigid lining substantially covers the actuator rod for protecting the actuator rod against nicks and abrasions due to flying gravel and the like.

6 Claims, 1 Drawing Sheet

POWER TRIM CYLINDER PROTECTIVE LOCKING DEVICE FOR AN INBOARD/OUTBOARD BOAT MOTOR

FIELD OF THE INVENTION

The present invention relates generally to inboard/-outboard engines for propelling boats and in particular, to a support device for maintaining the outboard portion in a raised position to prevent contact with the ground during transportation.

BACKGROUND OF THE INVENTION:

When a boat motor having an outboard drive unit, such as an inboard/outboard motor or an outboard motor, is transported by means of a trailer or the like, it is necessary to maintain the outboard drive unit in a tilted position to prevent the lower portion of the unit from contacting the ground during transportation. Irregularities, such as bumps and potholes, in the road can cause the boat and trailer to bounce up and down and the lower portion of the outboard drive unit to come into contact with the road surface. Therefore, sufficient clearance must be maintained between the lower portion of the drive unit and the road surface to compensate for such irregularities.

Devices which retain the outboard drive unit of a boat engine in a tilted condition are known in the art. Some of these devices are tension devices, which attach the drive unit to another element, such as the transom of the boat or the trailer. Such devices have not proven satisfactory due to the fact that the relative movement between the boat and the trailer during travel may dislodge the support device or create a strain between the boat and the outboard drive unit.

Other support devices may employ rigid brace members or the like to prop up the drive unit in a tilted position. Such brace members particularly extend between a stationary portion of the outboard drive unit, such as the transom coupling, and a movable portion, such as the transmission housing. These rigid brace members generally do not provide sufficient stability to hold the unit securely in a tilted position over extremely rough terrain. In addition, many of these devices may become dislodged during travel or may create an undesirable strain on the outboard drive unit.

It is desirable in the present invention to provide an improved and simplified traveling support device for an outboard engine. Further, it is desirable to provide a device for holding the outboard drive unit of a boat engine in a tilted position during travel. In addition, it is desirable to provide a support device for maintaining an outboard engine in a tilted position, while protecting the hydraulic piston rod of the tilt mechanism against nicks and abrasions which could cause hydraulic fluid leaks.

SUMMARY OF THE INVENTION

The present invention provides means engageable between the hydraulic cylinder of the trim mechanism and the pivotable connection of the actuator rod for maintaining the actuator rod in an extended position. Preferably, the means substantially encompasses the periphery of the actuator rod substantially along its entire longitudinal length for protecting the actuator rod against abrasions and nicks which may cause loss of hydraulic fluid. In its preferred form, the support device takes the form of an elongated rigid casing having a longitudinal axis and a radial slot extending along the entire longitudinal length of the casing, and a semi-rigid lining disposed within the casing forming a longitudinal aperture communicating with the radial slot through the casing, such that with the trim means in the raised position, and the actuator piston rod extended, the casing is engageable over the actuator rod for maintaining the movable portion of the outboard unit in the raised position for travel wherein the rigid casing engages against the cylinder of the trim means at one end and the pivot support of the actuator rod at another end and the lining substantially covers the actuator rod for protecting the rod against nicks and abrasions. The elongated rigid casing can be formed of rigid plastic material preferably taking the form of a rigid plastic sleeve or cylinder. The semi-rigid lining can be formed of material such as styrofoam or rubber and preferably is adhesively secured to the interior surface of the rigid plastic cylindrical casing.

DESCRIPTION OF THE PREFERRED EMBODIMENT

Figure 1:
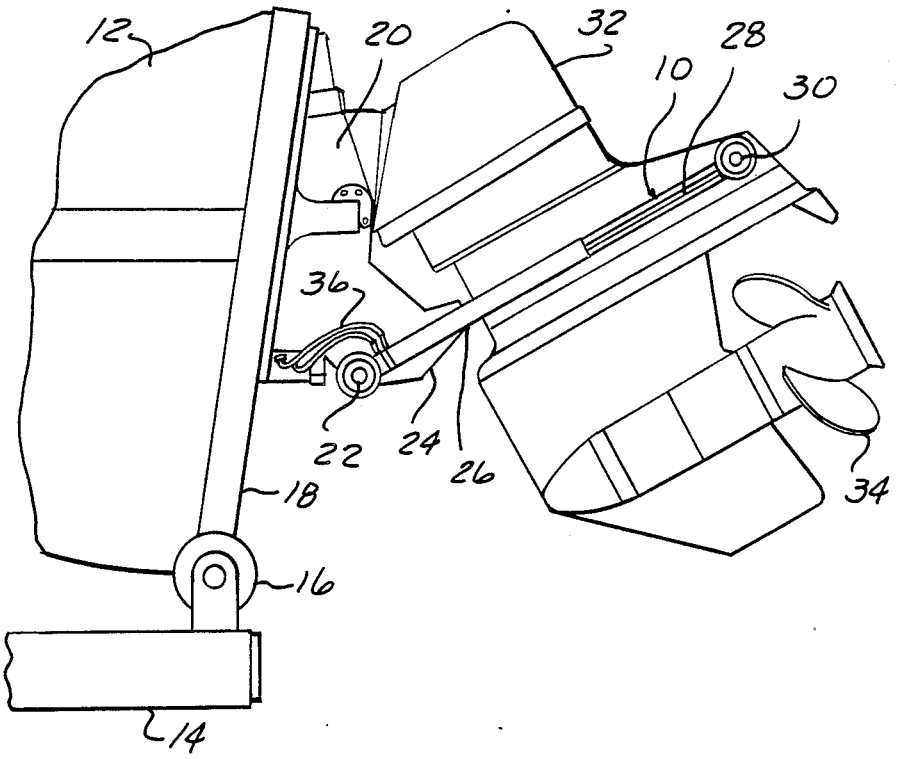
FIG. 1 is a side elevational view, showing a support device according to the present invention for retaining a drive unit in a raised position.

According to the present invention, a support device 10 is employed in association with a boat 12 which is supported by a trailer vehicle 14. The stern portion of the boat 12 is shown resting on a roller 16 of the trailer vehicle 14. The boat 12 has a transom 18 upon which a drive shaft housing 20 is mounted. At a lower portion of the drive shaft housing 20 is a pivotable support connection 22 which is carried by spaced-apart wall members 24 of the drive shaft housing 20.

Typically, a pair of hydraulic power cylinders 26 are attached to the pivotable support connections 22, with the wall members 24 between the hydraulic power cylinders 26. Each power cylinder 26 has an actuator rod 28 extending therefrom and movable thereby. Each actuator rod 28 is pivotally attached at a connection 30 to a propeller drive unit 32, which is provided with a propeller 34.

When the boat 12 is supported on the trailer vehicle 14 and it is desired to transport the boat 12, the hydraulic power cylinders 26 are actuated as fluid is forced thereinto through fluid conduits 36. The drive unit 32 is thus forced to tilt upwardly into the raised position as illustrated in FIG. 1. The support device 10 of this invention is moved into position substantially encompassing the extended actuator rod 28 of the trim mechanism. The support device 10 extends along substantially the entire longitudinal length of the extended actuator rod 28 from the hydraulic cylinder 26 to the pivotal connection 30 of the actuator rod 28 to the movable portion of the propeller drive unit 32. The hydraulic power cylinders 26 are actuated to permit the drive unit 32 to pivot slightly downwardly. This slight movement firmly positions the support device 10 on the actuator rod 28 between the cylinder 26 and the connection 30. Thus, the boat 12 can be transported on the trailer 14 with the propeller drive unit 32 tilted upwardly and without the possibility of the propeller drive unit 32 moving with respect to the stationary portion of the drive shaft housing 20. The boat 12 is thereby transportable with the entire propeller drive unit 32 above the level of the surface on which the trailer 14 travels. Damage to the drive unit 32 and propeller 34 during transit is therefore avoided.

Figure 2:
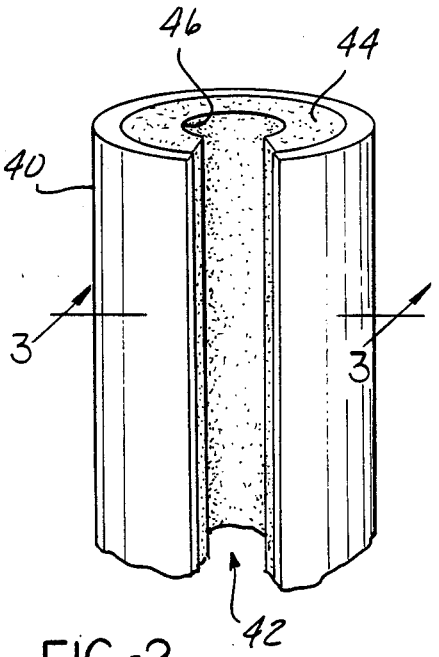
FIG. 2 is a perspective view of a portion of the support device according to the present invention.
Figure 4:
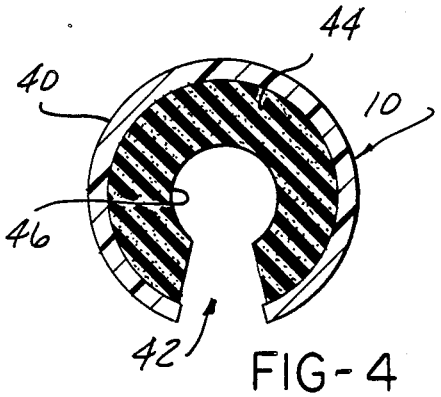
FIG. 4 is a cross-sectional view of a preferred embodiment of the support device according to the present invention.
Figure 3:
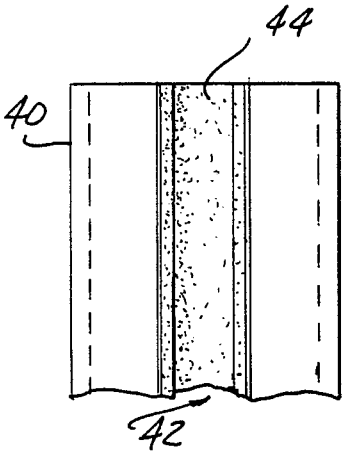
FIG. 3 is a side elevational view of the support device taken as shown in FIG. 2.

Preferably, the support device 10 takes the form as shown in detail in FIGS. 2 through 4. The support device 10 maintains an outboard unit of a boat engine in a tilted position for travel. The outboard unit includes a stationary portion, such as drive shaft housing 20, attached to a boat transom 18. A movable portion, such as propeller drive unit 32, houses a transmission and supports the propeller 34. The movable portion is pivotally mounted with respect to the stationary portion and is tiltable to a desired angle between a lowered position and a raised position by way of trim means. The trim means includes a pair of hydraulic power cylinders 26 having a hydraulically operated piston and attached actuator rod 28 engaged between the movable portion and the stationary portion. The support device provides means engageable over the actuator rod 28 seating against the hydraulic cylinder 26 at one end and against the pivotal connection 30 of the actuator rod 28 to the movable propeller drive unit 32 at the other end for maintaining the movable portion in the raised position for travel and for protecting the actuator rod 28 against nicks and abrasions due to flying gravel or the like which may result in hydraulic fluid leakage from the hydraulic cylinders 26. The support device 10 preferably includes an elongated rigid casing having a longitudinal axis and a radial slot 42 extending along the entire longitudinal length of the casing 40. A semi-rigid lining 44 is disposed within the casing 40 forming a longitudinal aperture 46 communicating with the radial slot 42 through the casing 40. The aperture is key-hole-shaped in transverse cross section, and has a generally cylindrical bore as seen in FIG. 4. The aperture has opposing sidewalls which taper inwardly toward one another, such that at their intersection with the bore, they are spaced from one another a distance which is less than the diameter of the bore. With the actuator rod 28 in the extended position, the casing 40 is engageable over the actuator rod 28 for maintaining the propeller drive unit 32 in the raised position for travel, wherein the rigid casing 40 substantially encompasses the actuator rod 28 and engages against the hydraulic cylinder 26 at one end and against the pivot support connection 30 of the actuator rod 28 at another end. The substantial covering of the actuator rod 28 protects the actuator rod 28 against nicks and abrasions due to flying gravel or the like during transportation. Preferably, the rigid casing 40 is formed of a rigid plastic material in the shape of a sleeve or cylinder. The semi-rigid lining is preferably formed of semi-rigid styrofoam, rubber or other suitable material. The lining 44 is preferably adhesively secured to the interior wall of the casing 40.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

What is claimed is:

1. A support device for maintaining an outboard unit of a boat engine in a tilted position for travel, said outboard unit having a stationary drive shaft housing attached to a boat transom, a movable propeller drive unit pivotally mounted with respect to the stationary drive shaft housing, and trim means including a cylinder, a hydraulically operated piston, and an actuator rod engaged between the movable propeller drive unit and the stationary drive shaft housing for tilting the movable propeller drive unit to a desired angle between a lowered position and a raised position, the support device comprising:

a single-piece, elongated rigid plastic sleeve having a longitudinal axis and a radial slot extending along the entire longitudinal length of the sleeve; and a semi-rigid styrofoam lining adhesively secured within the sleeve extending along the entire longitudinal length of the sleeve; the lining having a longitudinal key-hole-shaped aperture in transverse cross section communicating with the radial slot through the sleeve, such that with the trim means in the raised position and the actuator rod extended, the sleeve is engageable over the actuator rod for supporting the movable propeller drive unit in the raised position for travel, wherein the sleeve engages against the cylinder at one end and against a pivot support of the actuator rod at another end, and the styrofoam lining substantially covers the actuator rod for protecting the actuator rod against nicks and abrasions.

2. A support device for maintaining an outboard unit of a boat engine in a tilted position for travel, the outboard unit having a stationary drive shaft housing attaching to a boat transom, a movable propeller drive unit pivotally mounted with respect to the stationary shaft housing, and trim means including a cylinder, a hydraulically operated piston, and an actuator rod engaged between the movable propeller drive unit and the stationary drive shaft housing for tilting the movable propeller drive unit to a desired angle between a lowered position and a raised position, the support device comprising:

a single piece, elongated rigid casing having a longitudinal axis and a radial slot extending along the entire longitudinal length of the casing; and a semi-rigid lining fixedly disposed within the casing extending along the entire longitudinal length of the casing, the lining having a longitudinal key-hole-shaped aperture in transverse cross section communicating with the radial slot through the casing, such that with the trim means in the raised position and the actuator rod extended, the casing is engageable over the actuator rod for supporting the movable propeller drive unit in the raised position for travel wherein the rigid casing substantially encompasses the actuator rod and engages against the cylinder at one end and against a pivot support connection of the actuator rod at another end, and the semi-rigid lining substantially covers the actuator rod for protecting the actuator rod against nicks and abrasions.

3. The support device of claim 2, further comprising said lining having a greater radial thickness than the casing.

4. The support device of claim 2, further comprising said key-shaped aperture in said lining including a longitudinal bore and opposing sidewalls tapering inwardly toward one another in a radially inward direction from said casing toward said longitudinal bore.

5. The support device of claim 4, wherein said opposing sidewalls intersect said longitudinal bore at a distance spaced from one another that is less than the diameter of said longitudinal bore.

6. A support device for maintaining an outboard unit of a boat engine in a tilted position for travel, the outboard unit having a stationary drive shaft housing attaching to a boat transom, a movable propeller drive unit pivotally mounted with respect to the stationary shaft housing, and trim means including a cylinder, a hydraulically operated piston, and an actuator rod engaged between the movable propeller drive unit and the stationary drive shaft housing for tilting the movable propeller drive unit to a desired angle between a lowered position and a raised position, the support device comprising:

a single piece, elongated rigid casing having a longitudinal axis and a radial slot extending along the entire longitudinal length of the casing; and a semi-rigid lining fixedly disposed within the casing extending along the entire longitudinal length of the casing, the lining having a greater radial thickness than the casing and having a longitudinal key-hole-shaped aperture in transverse cross section communicating with the radial slot through the casing, the key-hole-shaped aperture in the lining including a longitudinal bore and opposing sidewalls tapering inwardly toward one another in a radially inward direction from the casing toward the longitudinal bore, the opposing sidewalls intersecting the longitudinal bore at a distance spaced from one another that is less than the diameter of the longitudinal bore, such that with the trim means in the raised position and the actuator rod extended, the casing is engageable over the actuator rod for supporting the movable propeller drive unit in the raised position for travel wherein the rigid casing substantially encompasses the actuator rod and engages against the cylinder at one end and against a pivot support connection of the actuator rod at another end, and the semi-rigid lining substantially covers the actuator rod for protecting the actuator rod against nicks and abrasions.

* * * * *